United States Patent [19]

Polsky

[11] 3,952,428

[45] Apr. 27, 1976

[54] BICYCLE SHOE

[76] Inventor: Robert A. Polsky, 31 Mayer Drive, Suffern, N.Y. 10901

[22] Filed: Feb. 24, 1975

[21] Appl. No.: 552,838

[52] U.S. Cl. ..... 36/131 WI; 36/32 R
[51] Int. Cl.[2] ..... A43B 13/04
[58] Field of Search ..... 36/32 R, 25 R, 1, 2.5 R, 36/34 R, 2.5 A, 2.5 AD

[56] References Cited

UNITED STATES PATENTS

| | | | |
|---|---|---|---|
| 953,077 | 3/1910 | Warney | 36/32 R |
| 2,985,971 | 5/1961 | Murawski | 36/32 R |
| 3,593,436 | 7/1971 | Vietas | 36/32 R |
| 3,875,689 | 4/1975 | Tomas | 36/32 R |

*Primary Examiner*—Patrick D. Lawson
*Attorney, Agent, or Firm*—Leo C. Krazinski

[57] ABSTRACT

A bicycle shoe having an outsole especially adapted for gripping a pedal of a bicycle, including an elongated heel terminating in a sloping front inner face, a toe portion having alternate cylindrical protuberances and hollows, and a recessed instep having alternate frusto pyramidal protuberances and hollows for mesh engagement with hollows and protuberances of a bicycle pedal.

8 Claims, 4 Drawing Figures

BICYCLE SHOE

BACKGROUND OF THE INVENTION

1. Field of the Invention

The present invention relates to an article of footwear and, more particularly, to shoes for riding bicycles.

2. Description of the Prior Art

Heretofore, it has been conventional practice to provide bicycle shoes with detachable soles, as indicated in U.S. Pat. No. 472,214, with soles of composite construction, as indicated in U.S. Pat. No. 468,223, and in flexible molded shoes having indentations therein, as indicated in U.S. Pat. No. 3,114,981. Also, it has been conventional practice to provide attachments for pedals of bicycles designed to hold the foot onto the pedal, as in U.S. Pat. Nos. 590,685 and 598,325.

SUMMARY OF THE INVENTION

Accordingly, an object of the invention is to provide an improved bicycle shoe in which the outsole design enables the rider's shoe to engage the pedal and hold it in place while riding the bicycle.

Another object of the invention is to provide an improved bicycle shoe in which the outsole includes a recessed portion between the heel and toe portions with corrugations for mesh engagement with corrugations of the bicycle pedal.

Still another object of the invention is to provide an improved bicycle shoe having an outsole with a heel having a sloping face for keeping an engaged pedal from slipping from the shoe while pedalling the bicycle.

A further object of the invention is to provide an improved bicycle shoe that also is well adapted for walking, hiking, playing in sports, and the like.

Yet another object of the invention is to provide an improved bicycle shoe that is also attractive in appearance.

Other and further objects will be obvious upon an understanding of the illustrative embodiment about to be described, or will be indicated in the appended claims and various advantages not referred to herein will occur to one skilled in the art upon employment of the invention in practice.

BRIEF DESCRIPTION OF THE DRAWINGS

A preferred embodiment of the invention has been chosen for purposes of illustration and description and is shown in the accompanying drawings, forming a part of the specification, wherein.

DESCRIPTION OF THE PREFERRED EMBODIMENT

Figure 1:
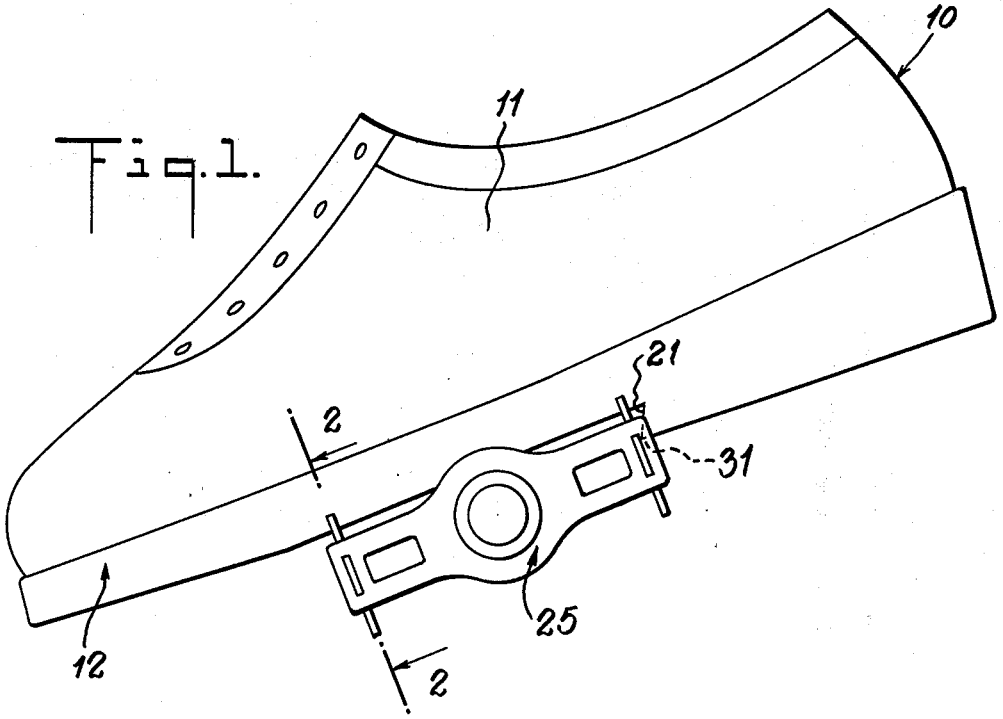
FIG. 1 is a side elevational view of a bicycle shoe in accordance with the present invention showing the shoe resting upon a bicycle pedal.

Referring now to FIGS. 1 to 4 of the drawings in detail, there is shown a shoe 10 for use particularly in pedalling a bicycle (not shown), while at the same time being useful in walking, hiking and playing in sports.

The shoe 10 includes an upper 11 and an outsole 12, preferably of composition material to provide lightness in weight, being formed with a heel 13, an instep portion 14 and a toe portion 16.

Figure 3:
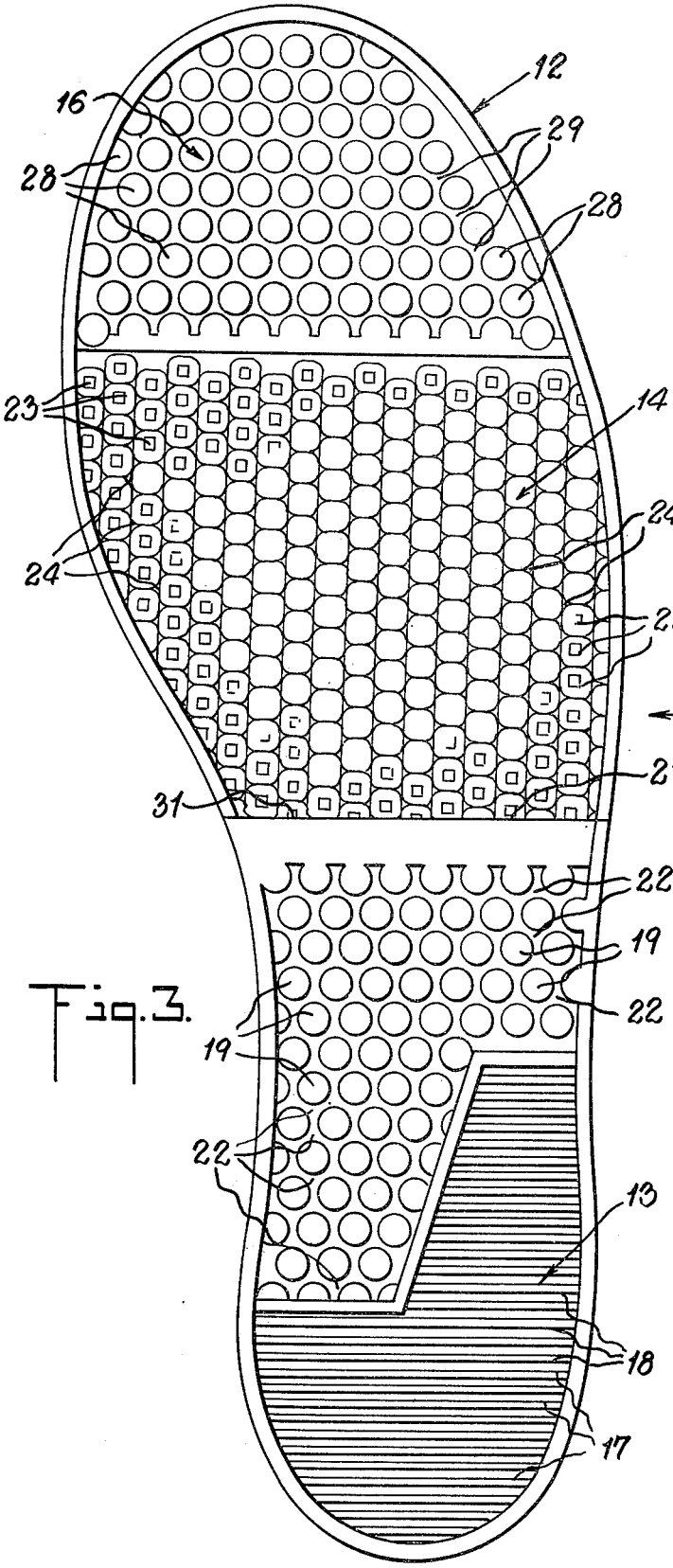
FIG. 3 is a bottom plan view of the outsole of the shoe.
Figure 4:
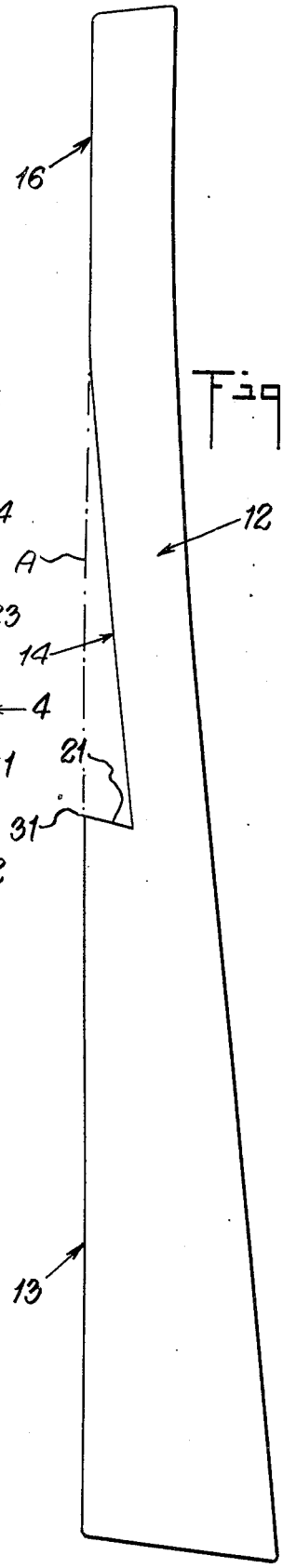
FIG. 4 is a side elevational view of the outsole looking in the direction of the arrow 4.

As shown in FIGS. 3 and 4, the heel 13 is almost one-half the length of the outsole and is formed with a plurality of horizontally spaced apart grooves 17 with ridges 18 therebetween. The horizontal grooves 17 and ridges 18 extend from the back of the heel 13 towards the instep 14, in formation similar to that of a reverse Z, and the rest of heel is formed with rows of spaced cylindrical protuberances 19. As shown in FIGS. 1 and 4, the heel 13 is shown with an inwardly sloping face 21, for a purpose to be described later. While the outline of the heel 13 shown in FIG. 4 is substantially a straight line, it is to be noted that the horizontal grooves 17 are only of slight depth, about one-sixty-fourth of an inch, while recesses 22 formed between the cylindrical protuberances 19 are much deeper, about one-eighth of an inch.

Figure 2:
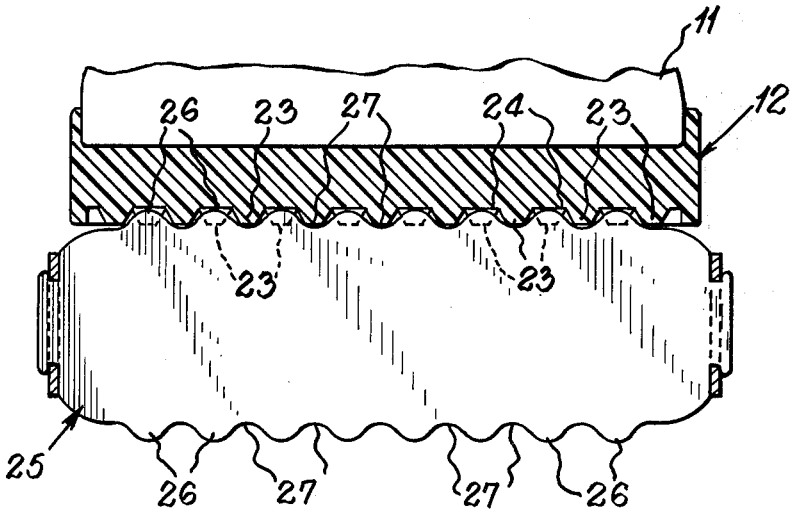
FIG. 2 is an enlarged sectional view taken along the line 2—2 on FIG. 1 showing the mesh engagement between the shoe and bicycle pedal protuberances.

Referring to FIGS. 2, 3 and 4, the instep portion 14 is substantially recessed, as is evident in FIG. 4, by running a straight, dash line A along heel 13 and toe portion 12. Within this recess is formed a plurality of frusto pyramidal protuberances 23 alternating with recesses 24 therebetween, the frusto pyramidal protuberances 23 being about one-eighth of an inch in height. The spacing of the protuberances 23 and recesses 24 is similar to that found in a pedal 25 of a bicycle, namely, protuberances 26 and recesses 27, shown in FIG. 2.

As seen in FIG. 3, the toe portion 12 of the outsole 11 is formed with a plurality of rows of spaced cylindrical protuberances 28 and recesses 29 therebetween. Here again the protuberances 28 are about one-eighth of an inch in height.

Referring now to FIGS. 1 and 2, it is readily seen that the shoe 10 of this invention, particularly the recessed instep portion 14, is designed to grip and hold the pedal 25 in a continual engagement during the pedalling operation, especially with the assistance of the sloping heel face 21, the point 31 of which presses against rear side of the pedal 25 (FIG. 1). In FIG. 2 it is clearly shown how the respective protuberances 23 and recesses 24 of the recessed instep portion 14 mesh with the recesses 27 and protuberances 26 of the pedal 25, so that no lateral or forward movement between the shoe 10 and the pedal 25 is possible. In other words, the pedal 25 is gripped and held by the shoe 10 once the pedal and shoe are in mesh.

While the shoe of this invention is particularly adapted to bicycle pedalling, it can also be used for other purposes, such as walking, hiking, and playing in various sports. Such other use will not impair the critical frusto pyramidal protuberances 23 because the instep portion 14 is sufficiently recessed to keep the protuberances 23 intact.

From the foregoing description it will be seen that the present invention provides an improved shoe which is particularly adapted for saft bicycle pedalling but is useful as well for other purposes.

As various changes may be made in the form, construction, and arrangement of the parts herein, without departing from the spirit and scope of the invention and without sacrificing any of its advantages, it is to be understood that all matters are to be interpreted as illustrative and not in any limiting sense.

What is claimed is:

1. A shoe for use in propelling bicycles equipped with pedals, said shoe comprising, in combination, an upper and an outsole, said outsole consisting of heel, instep and toe portions, said instep portion being substantially recessed with respect to said heel and toe portions, said heel portion including a sloping face having a forward point adapted to engage said bicycle pedal, and a plurality of spaced protuberances and cavities in said instep portion adapted for respective engagement with similarly spaced cavities and protuberances on said bicycle pedals, whereby said bicycle pedals are gripped by said shoes.

2. A shoe in accordance with claim 1, wherein said first mentioned protuberances are frusto pyramidal in shape.

3. A shoe in accordance with claim 2, wherein said spaced frusto pyramidal protuberances and cavities are respectively in mesh engagement with said spaced pedal cavities and protuberances.

4. A shoe in accordance with claim 1, wherein said heel portion is almost one-half the length of the outsole.

5. A shoe in accordance with claim 4, wherein said heel portion includes spaced horizontally extending grooves and ridges at a rear portion of the heel and a plurality of spaced protuberances and cavities at a front portion of the heel.

6. A shoe in accordance with claim 5, wherein said heel protuberances are cylindrical in shape.

7. A shoe in accordance with claim 6, wherein said toe portion includes a plurality of spaced protuberances and cavities.

8. A shoe in accordance with claim 7, wherein said toe portion protuberances are cylindrical in shape.

* * * * *